US008107843B2

(12) United States Patent
Law

(10) Patent No.: US 8,107,843 B2
(45) Date of Patent: Jan. 31, 2012

(54) DIGITAL FUSER USING MICRO HOTPLATE TECHNOLOGY

(75) Inventor: Kock-Yee Law, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 974 days.

(21) Appl. No.: 12/060,427

(22) Filed: Apr. 1, 2008

(65) Prior Publication Data

US 2009/0245840 A1 Oct. 1, 2009

(51) Int. Cl.
*G03G 15/20* (2006.01)

(52) U.S. Cl. ..... 399/69

(58) Field of Classification Search ..... 399/69, 399/333

See application file for complete search history.

(56) References Cited

U.S. PATENT DOCUMENTS

| | | | | |
|---|---|---|---|---|
| 4,801,968 | A * | 1/1989 | Kogure et al. | 399/334 |
| 5,345,213 | A | 9/1994 | Semancik et al. | |
| 5,464,966 | A | 11/1995 | Gaitan et al. | |
| 6,466,750 | B2 * | 10/2002 | McIntyre | 399/67 |

OTHER PUBLICATIONS

Panchapakesan et al., "Sensitivity, Selectivity, and Stability of Tin Oxide Nanostructures on Large Area Arrays of Microhotplates", Institute of Physics Publishing, Nanotechnology, 17, 2006, pp. 415-425.

Semancik et al., "Kinetically Controlled Chemical Sensing Using Micromachined Structures", Accounts of Chemical Research, vol. 31, No. 5, 1998, pp. 279-287.

Suehle et al., "Tin Oxide Gas Sensor Fabricated Using CMOS Micro-Hotplates and In-Situ Processing", IEEE Electron Device Letters, vol. 14, No. 3, Mar. 1993, pp. 118-120.

Taylor et al., "A Microarray Approach for Optimizing Localized Deposition of Carbon Nanotubes Using Microhotplate Arrays", Institute of Physics Publishing, Nanotechnology, 15, 2004, pp. 62-65.

* cited by examiner

*Primary Examiner* — David Gray
*Assistant Examiner* — Andrew Do
(74) *Attorney, Agent, or Firm* — MH2 Technology Law Group LLP

(57) ABSTRACT

In accordance with the invention, there are printing apparatuses and methods of marking and forming an image. The printing apparatus can include one or more digital heating elements disposed in a fuser subsystem, the digital heating element can include an array of hotplates, wherein each hotplate of the array of hotplates can be thermally isolated and can be individually addressable, wherein each hotplate can be configured to attain a temperature up to approximately 200° C. from approximately 20° C. in a time frame of milliseconds.

23 Claims, 6 Drawing Sheets

DIGITAL FUSER USING MICRO HOTPLATE TECHNOLOGY

DESCRIPTION OF THE INVENTION

1. Field of the Invention

The present invention relates to printing and marking devices and more particularly to digital fuser subsystems and methods of using them.

2. Background of the Invention

Current fusing systems in marking (dry and direct) are very inefficient in regards to energy consumption. For example, in a typical fuser roll, only about 1% of the heat is used to fix the toner images, about 50% of the heat is used to warm up the paper and the rest of the heat is wasted during stand-by or idle state. While waste heat can be minimized by better thermal management, such as, for example by proper insulation and heat exchange, currently there is no way to reduce the amount of heat required to warm up the paper during fusing.

Accordingly, there is a need to overcome these and other problems of prior art to provide digital fusing subsystems that can reduce the amount of wasted heat, for example by heating only those areas where the toner image will be.

SUMMARY OF THE INVENTION

In accordance with various embodiments, there is a printing apparatus. The printing apparatus can include one or more digital heating elements disposed in a fuser subsystem, the digital heating element can include an array of hotplates, wherein each hotplate of the array of hotplates can be thermally isolated and can be individually addressable, wherein each hotplate can be configured to attain a temperature up to approximately 200° C. from approximately 20° C. in a time frame of milliseconds.

According to various embodiments, there is a method of forming an image. The method can include providing an imaging station for forming a latent image on an electrophotographic photoreceptor and providing a development subsystem for converting the latent image to a toner image on the electrophotographic photoreceptor. The method can also include providing a fuser subsystem including one or more digital heating elements for fixing the toner image onto a media, each of the one or more digital heating elements can include an array of hotplates, wherein each hotplate is thermally isolated and is individually addressable. The method can further include selectively heating one or more hotplates that correspond to the toner image to a temperature in the range of approximately 20° C. to approximately 200° C. in a time frame of milliseconds and feeding the media through the fuser subsystem to fix the toner image onto the media.

According to yet another embodiment, there is a marking method. The marking method can include feeding a media in a marking system, the marking system can include one or more digital heating elements, each of the one or more digital heating elements can include an array of hotplates, wherein each hotplate is thermally isolated and is individually addressable. The marking method can also include transferring and fusing an image onto the media by heating one or more hotplates that correspond to the toner image to a temperature in the range of approximately 20° C. to approximately 200° C. in a time frame of milliseconds and transporting the media to a finisher.

Additional advantages of the embodiments will be set forth in part in the description which follows, and in part will be obvious from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

Figure 1:
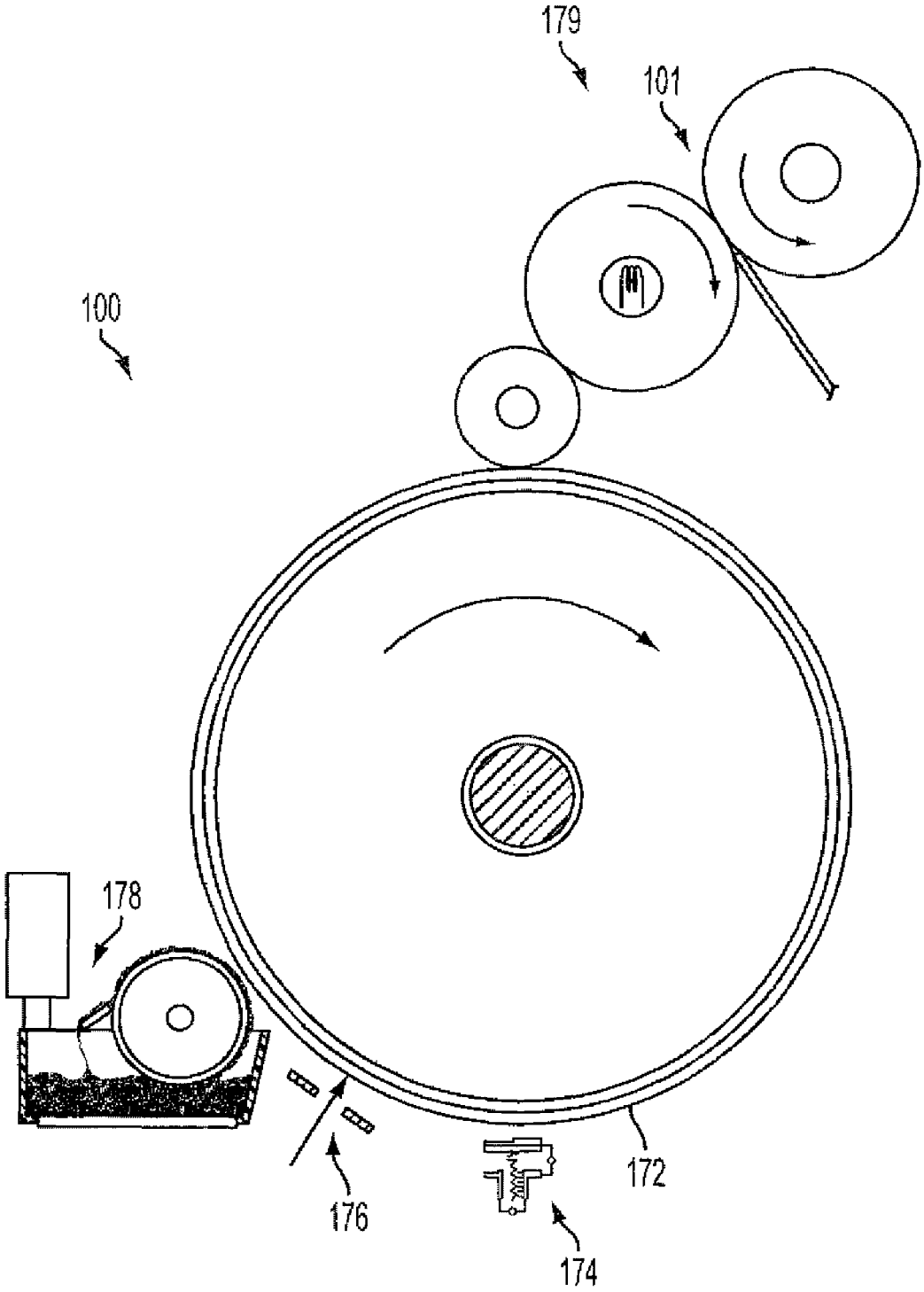
FIG. 1 schematically illustrates an exemplary printing apparatus.

FIG. 1 schematically illustrates an exemplary printing apparatus 100. The exemplary printing apparatus 100 can include an electrophotographic photoreceptor 172 and a charging station 174 for uniformly charging the electrophotographic photoreceptor 172. The electrophotographic photoreceptor 172 can be a drum photoreceptor as shown in FIG. 1 or a belt photoreceptor (not shown). The exemplary printing apparatus 100 can also include an imaging station 176 where an original document (not shown) can be exposed to a light source (also not shown) for forming a latent image on the electrophotographic photoreceptor 172. The exemplary printing apparatus 100 can further include a development subsystem 178 for converting the latent image to a visible image on the electrophotographic photoreceptor 172 and a transfer subsystem 179 for transferring the visible image onto a media and a fuser subsystem 101 for fixing the visible image onto a media.

Figure 4A:
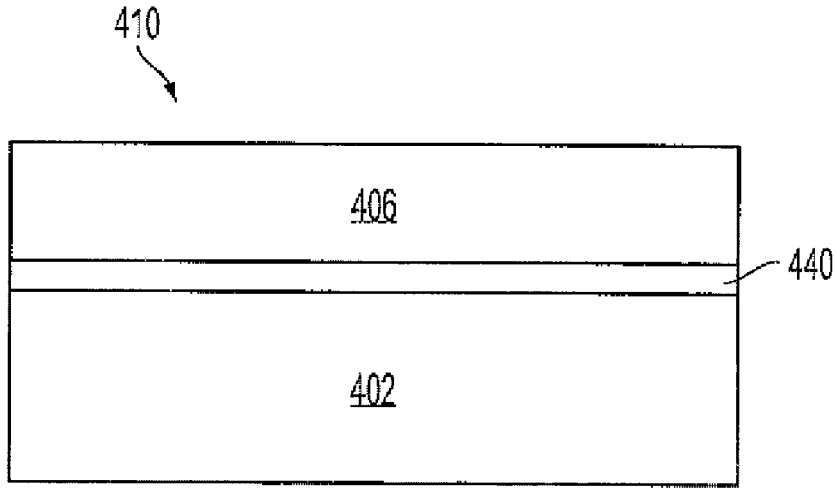
FIG. 4A schematically illustrates a cross section of an exemplary fuser member, according to various embodiments of the present teachings.
Figure 4B:
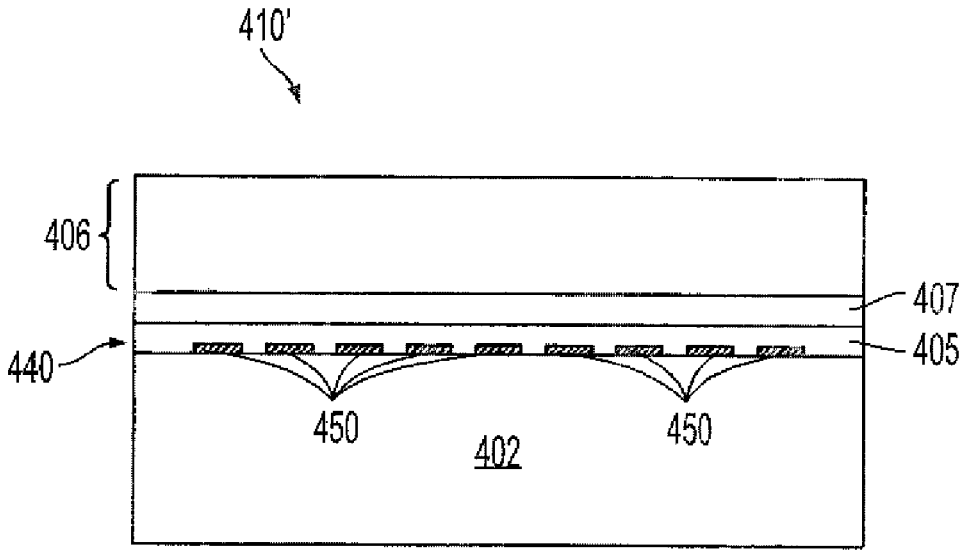
FIG. 4B schematically illustrates a cross section of another exemplary fuser member, according to various embodiments of the present teachings.

In various embodiments, the fuser subsystem 101 of the printing apparatus 100 can include one or more digital heating elements 540 shown in FIG. 5. The fuser subsystem 101 of the printing apparatus 100 can include one or more of a fuser member, pressure members, external heat rolls, oiling subsystems, and transfix rolls. FIG. 4A shows an exemplary fuser member 410 including a digital heating element 440. The exemplary fuser member 410 can include a digital heating element 440 disposed over a substrate 402, and a toner release layer 406 disposed over the digital heating element 440. In various embodiments, the substrate 402 can be a high temperature plastic substrate. Exemplary high temperature plastic substrates can include, but are not limited to polyimide and PEEK. The thickness of the substrate 402 can be from about 50 μm to about 150 μm, and in some cases from about 65 μm to about 85 μm. In some embodiments, the toner release layer 406 can be a single layer including materials such as, for example, silicone and fluoroelastomer. The thickness of the toner release layer 406 can be from about 100 μm to about 500 μm, and in some cases from about 150 μm to about 250 μm. In other embodiments, the toner release layer 406 can be a double layer structure including a fluoroelastomer layer disposed over a silicone rubber layer. In some other embodiments, the toner release layer 406 can be a double layer structure including a thermoplastic layer such as, for example, PTFE and PFA disposed over a silicone rubber layer. The total thickness of the double layer structure of the toner release layer 406 can be from about 100 μm to about 500 μm, and in some cases from about 150 μm to about 250 μm, with the top layer thickness from about 20 μm to about 30 μm. In some embodiments, an electrically insulating layer 405 can be disposed over the digital heating element 440 including an array of hotplates 450, as shown in FIG. 4B. In various embodiments, the electrically insulating layer 405 can include any suitable material such as, for example, silicon oxide, polyimide, silicone rubber, and a fluoroelastomer. The thickness of the electrically insulating layer 405 can be from about 10 μm to about 50 μm, and in some cases from about 20 μm to about 30 μm. In certain embodiments, a thermal spreading layer 407 can be disposed over the electrically insulating layer 405, as shown in FIG. 4B. The thickness of the thermal spreading layer 407 can be from about 10 μm to about 50 μm, and in some cases from about 20 μm to about 30 μm. In some embodiments, the thermal spreading layer 407 can include thermally conductive fillers disposed in a polymer. In various embodiments, the thermally conductive fillers can be selected from the group consisting of graphites; graphenes; carbon nanotubes; micron to submicron sized metal particles, such as, for example, Ni, Ag, and the like; and micron to submicron sized ceramic fillers, such as, for example, SiC, $Al_2O_3$, and AlN. In other embodiments, the polymer in which the thermally conductive fillers are disposed can be selected from the group consisting of polyimides, silicones, and fluoroelastomers. However, one of ordinary skill in the art may choose any suitable thermally conductive filler disposed in any suitable polymer.

Figure 5A:
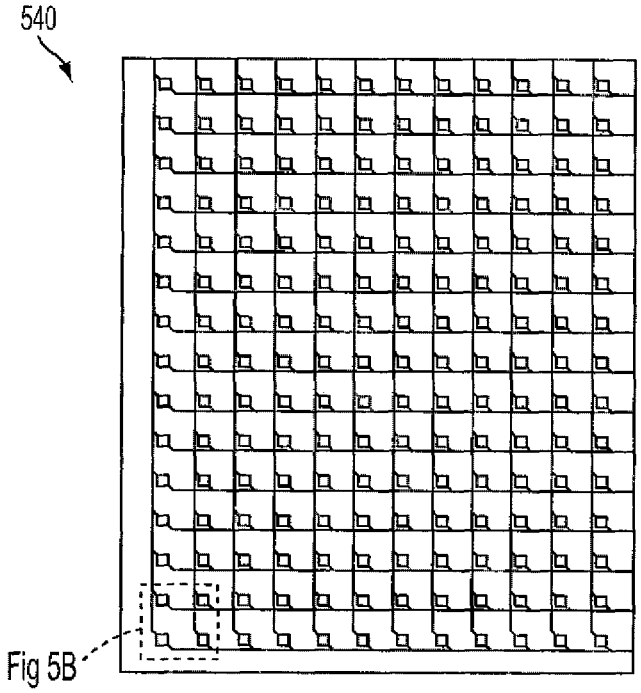
FIGS. 5A and 5B schematically illustrate an exemplary digital heating element, according to various embodiments of the present teachings.

Referring back to the digital heating element 440 disposed over the substrate 402, the digital heating elements 440, 540 can include an array of hotplates 550, as shown in FIG. 5A. Each hotplate 550 of the array of hotplates can be thermally isolated and can be individually addressable, and wherein each hotplate 550 can be configured to attain a temperature of up to approximately 200° C. from approximately 20° C. in a time frame of milliseconds. In some embodiments, the time frame of milliseconds can be less than about 100 milliseconds. In other embodiments, the time frame of milliseconds can be less than about 50 milliseconds. Yet, in some other embodiments, the time frame of milliseconds can be less than about 10 milliseconds. The phrase "individually addressable" as used herein means that each hotplate 550 of the array of hotplates 550 can be identified and manipulated independently of its surrounding hotplates 550, for example, each hotplate 550 can be individually turned on or off or can be heated to a temperature different from its surrounding hotplates 550. However in some embodiments, instead of addressing the hotplates 550 individually, a group of hotplates including two or more hotplates can be addressed together, i.e a group of hotplates can be turned on or off together or can be heated to a certain temperature together, different from the other hotplates or other groups of hotplates. For example, in case of printing text with a certain line spacing and margins, the hotplates 550 corresponding to the text can be heated to a certain temperature to fuse the toner, but the hotplates 550 corresponding to the line spacing between the text and the margins around the text can be turned off.

Figure 5B:
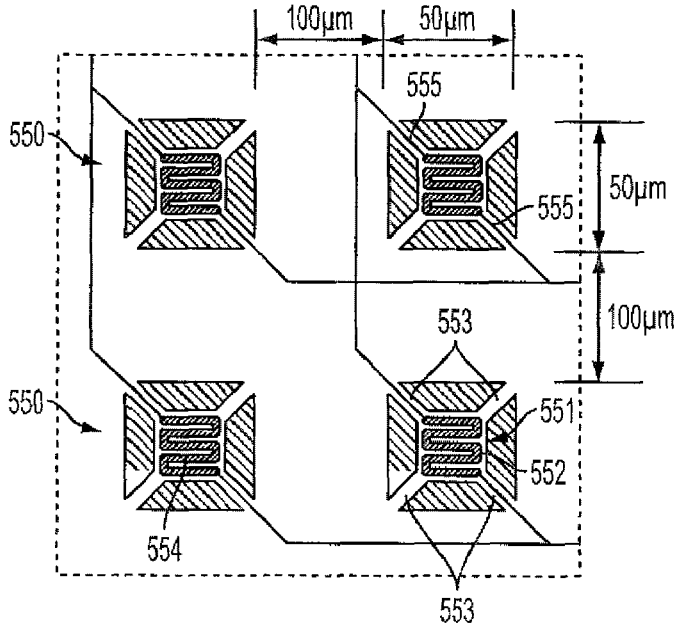

FIG. 5B shows a blown up view of a portion of the digital heating elements 540, shown in FIG. 5A. As shown in FIG. 5B, each hotplate 550 can include a membrane or a microbridge 551 having a central portion 552 and four support legs 553 extending from the central portion 552 to the edge of the hotplate 550. The hotplate 550 can also include a micro resistive heating element 554 and two leads 555 at opposite ends. In various embodiments, each hotplate 550 of the array of hotplates can have at least one of length and width less than approximately 200 μm. In some embodiments, the micro resistive heating element 554 can be made of any suitable material, including, but not limited to silicon, aluminum, and tungsten. U.S. Pat. No. 5,464,966 describes in detail the design and the fabrication methodology of hotplate 550, the disclosure of which is incorporated by reference herein in its entirety.

Referring back to the printing apparatus 100, in some embodiments, the printing apparatus 100 can be a xerographic printer, as shown in FIG. 1. In other embodiments, the printing apparatus 100 can be a liquid inkjet printer (not shown). In some other embodiments, the printing apparatus 100 can be a solid inkjet printer (not shown).

Figure 2:
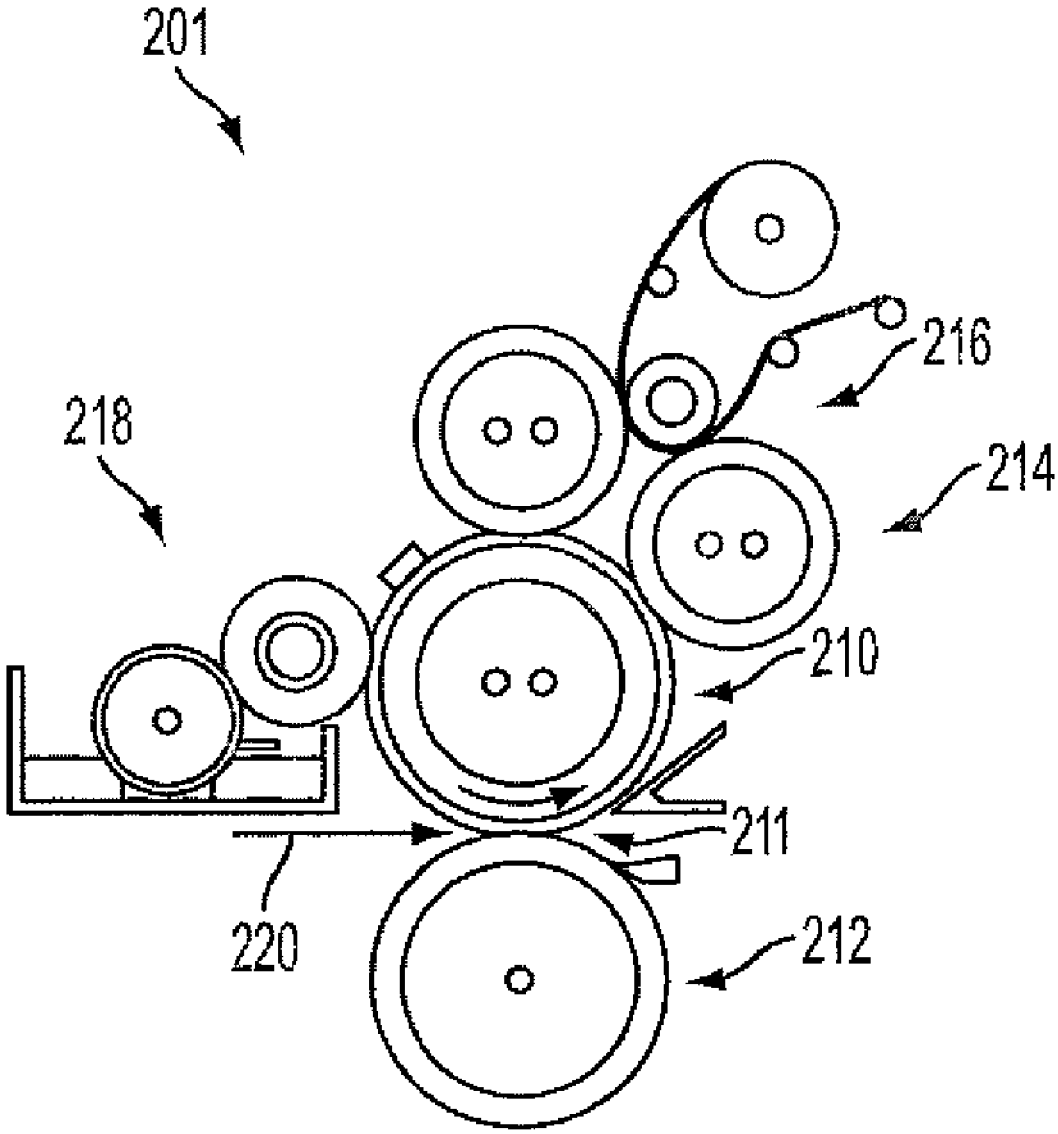
FIG. 2 schematically illustrates an exemplary fuser subsystem of a printing apparatus, according to various embodiments of the present teachings.

FIG. 2 schematically illustrates an exemplary fuser subsystem 201 of a xerographic printer. The exemplary fuser subsystem 201 as illustrated in FIG. 2 can include a fuser member 210 and a rotatable pressure member 212 that can be mounted forming a fusing nip 211. A media 220 carrying an unfused toner image can be fed through the fusing nip 211 for fusing. In some embodiments, the pressure member 212 can be a pressure roll, as shown in FIG. 2. In other embodiments, the pressure member 212 can be a pressure belt (not shown). The exemplary fuser subsystem 201 can also include an oiling subsystem 218 to oil the surface of the fuser member 210 to ease the removal of residual toner. The exemplary fuser subsystem 201 can further include external heat rolls 214 to provide additional heat source and cleaning subsystem 216. In various embodiments, one or more of fuser member 210, pressure members 212, external heat rolls 214, and oiling subsystem 218 can include digital heating element 540. In various embodiments, the digital heating elements, 440, 540 can be used as a heat source and can be disposed in the pressure member 212, the external heat rolls 214, and the oiling subsystem 218 in a configuration similar to that for the fuser member 410 as disclosed above and shown in FIGS. 4A and 4B.

Figure 3:
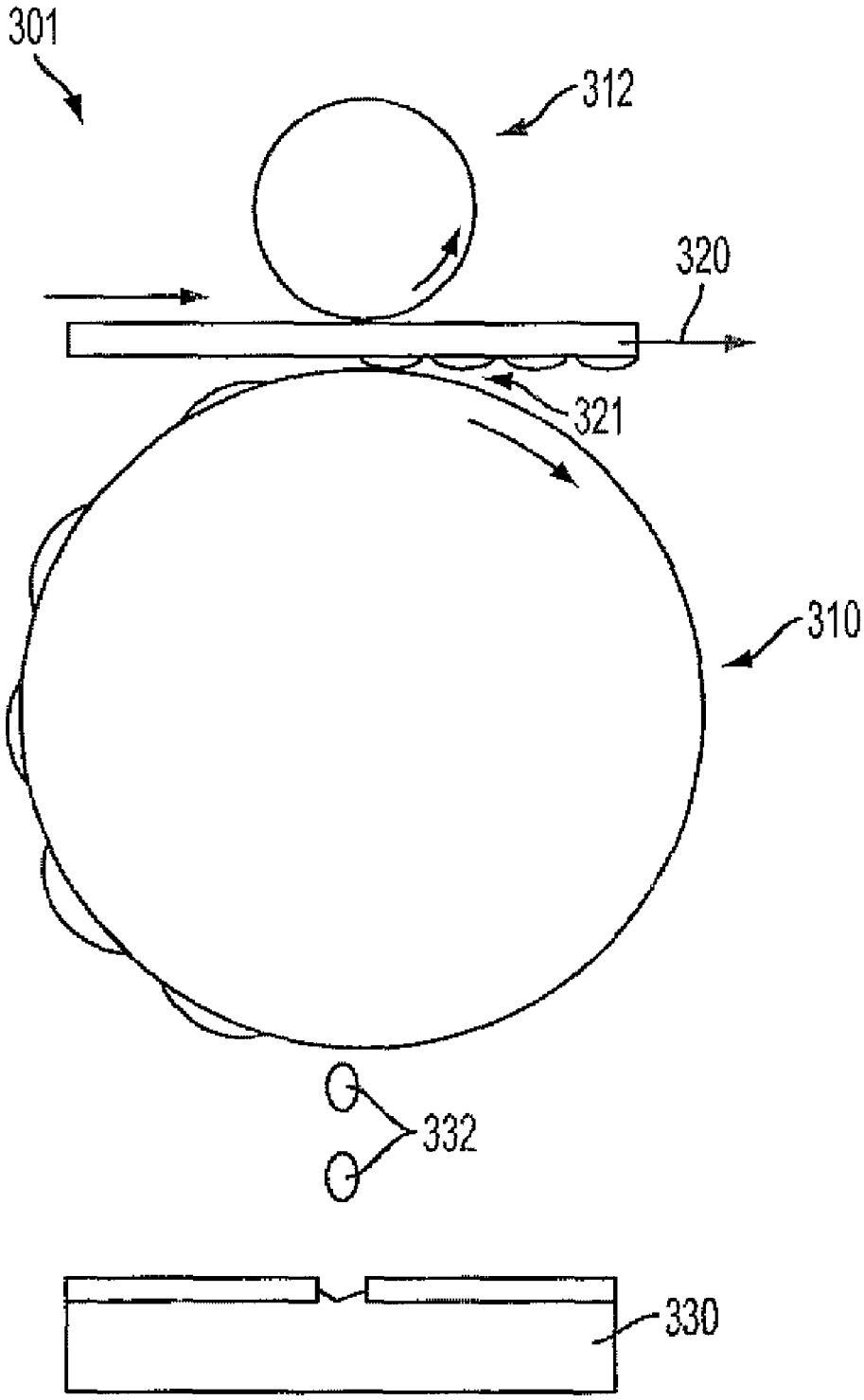
FIG. 3 schematically illustrates another exemplary fuser subsystem of a printing apparatus, according to various embodiments of the present teachings.

FIG. 3 schematically illustrates another exemplary fuser subsystem 301 of a solid inkjet printer. The exemplary fuser subsystem 301 as illustrated in FIG. 3 can include a solid ink reservoir 330. The solid ink can be melted by heating to a temperature of about 150° C. and the melted ink 332 can then be ejected out of the solid ink reservoir 330 onto a transfix roll 310. In various embodiments, the transfix roll 310 can be kept at a temperature in the range of about 70° C. to about 130° C. to prevent the ink 332 from solidifying. The transfix roll can be rotated and the ink can be deposited onto a media 320, which can be fed through a fusing nip 321 between the transfix roll 310 and a pressure roll 312. In some embodiments, the pressure roll 312 can be kept at a room temperature. In other embodiments, the pressure roll 312 can be heated to a temperature in the range of about 50° C. to about 100° C. In various embodiments, the digital heating elements, 440, 540 can be used as a heat source and can be disposed in the transfix roll 310 and/or the pressure roll 312 in a configuration similar to that for the fuser member 410, 410' as disclosed above and shown in FIGS. 4A and 4B. In various embodiments, the inclusion of the digital heating element 540 in the transfix roll 310 can allow heating only those parts of the transfix roll 310 that includes ink and correspond to the toner image by selectively addressing one or more hotplates 550 of the array of hotplates 550.

Figure 6:
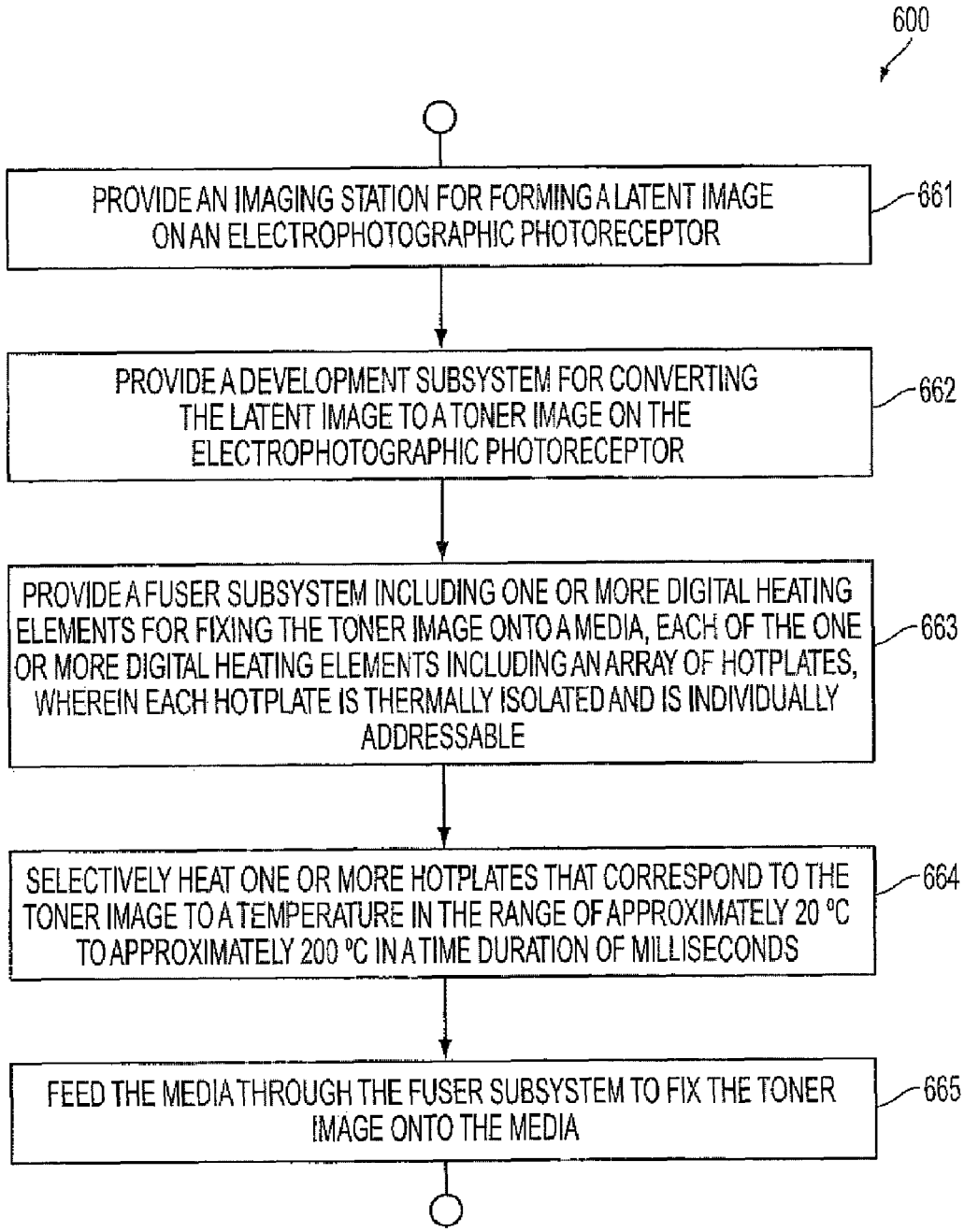
FIG. 6 shows an exemplary method of forming an image, according to various embodiments of the present teachings.

According to various embodiments, there is a method 600 of forming an image, as shown in FIG. 6. The method 600 can include providing an imaging station for forming a latent image on an electrophotographic photoreceptor, as in step 661. The method can also include providing a development subsystem for converting the latent image to a toner image on the electrophotographic photoreceptor, as in step 663. The method can further include a step 663 of providing a fuser subsystem including one or more heating elements for fixing the toner image onto a media, each of the one or more digital heating elements can include an array of hotplates as shown in FIG. 5A, wherein each hotplate of the array of hotplates can be thermally isolated and can be individually addressable. In certain embodiments, each hotplate can be configured to attain a temperature of up to approximately 200° C. from approximately 20° C. in a time frame of milliseconds. In some embodiments, the step 663 of providing a fuser assembly can include providing the fuser assembly in a roller configuration. In other embodiments, the step 663 of providing a fuser assembly can include providing the fuser assembly in a belt configuration. In some other embodiments, the step 663 of providing a fuser subsystem can include providing one or more of a fuser member, pressure members, external heat rolls, oiling subsystem, and transfix roll. In various embodiments, the method 600 can also include a step 664 of selectively heating one or more hotplates that correspond to the toner image to a temperature in the range of approximately 20° C. to approximately 200° C. in a time frame of milliseconds and step 665 of feeding the media through the fuser subsystem to fix the toner image onto the media. In certain embodiments, the step 664 of selectively heating one or more hotplates that correspond to the toner image can include selectively heating a plurality of group of hotplates, wherein each group of hotplates can be individually addressable. In various embodiments, the step 664 of selectively heating one or more hotplates can include heating a first group of hotplates to a first temperature, a second group of hotplates to a second temperature, the second temperature being different from the first temperature, and so on. One of ordinary skill in the art would know that there can be numerous reasons to heat a first group of hotplates to a first temperature, a second set of hotplates to a second temperature, the second temperature being different from the first temperature, and so on. Exemplary reasons can include, but are not limited to increasing energy efficiency and improving image quality. For example, in a given media, such as a paper, one can heat certain areas to a higher temperature if those areas have a higher toner coverage such as, due to graphic images. Also, one can heat some areas on a media to a higher temperature to increase the glossiness. In some embodiments, the method 600 can further include selectively pre-heating only those parts of the media that correspond to the toner image by selectively heating one or more hotplates of the array of hotplates that correspond to the toner image. In certain embodiments, the method 600 can further include adjusting an image quality of the image on the media by selectively heating only those parts of the media that corresponds to the image by selectively heating one or more hotplates of the array of hotplates that correspond to the image.

According to various embodiments, there is a marking method including feeding a media in a marking system, the marking system including one or more digital heating elements, each of the one or more digital heating elements including an array of hotplates, wherein each hotplate can be thermally isolated and can be individually addressable. The marking method can also include transferring and fusing an image onto the media by heating one or more hotplates that correspond to the toner image to a temperature in the range of approximately 20° C. to approximately 200° C. in a time frame of milliseconds. The marking method can further include transporting the media to a finisher. In various embodiments, the step of transferring and fusing an image onto the media by heating one or more hotplates that correspond to the toner image can include heating a first set of hotplates corresponding to a first region of the toner image to a first temperature, a second set of hotplates corresponding to a second region of the toner image to a second temperature, wherein the second temperature can be different from the first temperature, and so on. In some embodiments, the marking method can also include selectively pre-heating only those parts of a media that correspond to the toner image by selectively heating one or more hotplates of the array of hotplates that correspond to the toner image. In certain embodiments, the marking method can also include adjusting an image quality of the image on the media by selectively heating only those portions of the media that corresponds to the image by selectively heating one or more hotplates of the array of hotplates that correspond to the image.

While the invention has been illustrated respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the phrase "one or more of", for example, A, B, and C means any of the following: either A, B, or C alone; or combinations of two, such as A and B, B and C, and A and C; or combinations of three A, B and C.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A printing apparatus comprising:

one or more digital heating elements disposed in a fuser subsystem, the digital heating element comprising an array of hotplates, wherein each hotplate of the array of hotplates is thermally isolated and is individually addressable;

an electrically insulating layer disposed over at least one of the one or more digital heating elements; and a thermal spreading layer disposed over the electrically insulating laver, wherein the thermal spreading layer comprises thermally conductive fillers disposed in a polymer.

2. The printing apparatus of claim 1, wherein each hotplate of the array of hotplates has at least one of length and width less than approximately 200 μm.

3. The printing apparatus of claim 1, wherein at least one of the one or more digital heating elements is disposed over a high temperature plastic substrate.

4. The printing apparatus of claim 1, wherein the electrically insulating layer comprises a material selected from the group consisting of silicon oxide, polyimide, silicone rubber, and a fluoroelastomer.

5. The printing apparatus of claim 1, wherein the thermally conductive fillers are selected from the group consisting of graphites, graphenes, carbon nanotubes, micron to submicron sized metal particles, and micron to submicron sized ceramic fillers.

6. The printing apparatus of claim 1, wherein the polymer is selected from the group consisting of polyimides, silicones, and fluoroelastomers.

7. The printing apparatus of claim 1 further comprising a toner release layer over the thermal spreading layer.

8. The printing apparatus of claim 1, wherein fuser subsystem comprises one or more of a fuser member, pressure members, external heat rolls, oiling subsystems, and transfix rolls.

9. The printing apparatus of claim 1, wherein the printing apparatus is one of a xerographic printer, a liquid inkjet printer, and a solid inkjet printer.

10. The printing apparatus of claim 1, wherein each hotplate is configured to attain a temperature up to approximately 200° C. from approximately 20° C. in a time frame of milliseconds.

11. A method of forming an image comprising:

providing an imaging station for forming a latent image on an electrophotographic photoreceptor;

providing a development subsystem for converting the latent image to a toner image on the electrophotographic photoreceptor; and providing a fuser subsystem comprising one or more digital heating elements for fixing the toner image onto a media, each of the one or more digital heating elements comprising:

an array of hotplates, wherein each hotplate is thermally isolated and is individually addressable;

an electrically insulating layer disposed over at least one of the one or more digital heating elements; and a thermal spreading layer disposed over the electrically insulating layer, wherein the thermal spreading layer comprises thermally conductive fillers disposed in a polymer;

selectively heating one or more hotplates that correspond to the toner image; and feeding the media through the fuser subsystem to fix the toner image onto the media.

12. The method of claim 11, wherein the step of providing a fuser subsystem comprises providing one or more of fuser member, pressure members, external heat rolls, oiling subsystem, and transfix roll.

13. The method of claim 11, wherein the step of providing a fuser subsystem comprises providing the fuser subsystem in a roller configuration.

14. The method of claim 11, wherein the step of providing a fuser subsystem comprises providing the fuser subsystem in a belt configuration.

15. The method of claim 11, wherein the step of selectively heating one or more hotplates that correspond to the toner image comprises selectively heating a plurality of group of hotplates, wherein each group of hotplates is individually addressable.

16. The method of claim 11, wherein the step of selectively heating one or more hotplates comprises heating a first set of hotplates to a first temperature, a second set of hotplates to a second temperature, the second temperature being different from the first temperature, and so on.

17. The method of claim 11 further comprising selectively pre-heating only those parts of a media that correspond to the toner image by selectively heating one or more hotplates of the array of hotplates that correspond to the toner image.

18. The method of claim 11 further comprising adjusting an image quality of the image on the media by selectively heating only those portions of the media that corresponds to the image by selectively heating one or more hotplates of the array of hotplates that correspond to the image.

19. The method of claim 11, further comprising heating the one or more hotplates to a temperature in the range of approximately 20° C. to approximately 200° C. in a time frame of milliseconds during the selective heating.

20. A marking method comprising:

feeding a media in a marking system, the marking system comprising:

one or more digital heating elements, each of the one or more digital heating elements comprising an array of hotplates, wherein each hotplate is thermally isolated and is individually addressable;

an electrically insulating layer disposed over at least one of the one or more digital heating elements; and a thermal spreading layer disposed over the electrically insulating layer, wherein the thermal spreading layer comprises thermally conductive fillers disposed in a polymer;

transferring and fusing an image onto the media by heating one or more hotplates that correspond to the toner image; and transporting the media to a finisher.

21. The marking method of claim 20, wherein the step of transferring and fusing an image onto the media by heating one or more hotplates that correspond to the toner image comprises heating a first set of hotplates corresponding to a first region of the toner image to a first temperature, a second set of hotplates corresponding to a second region of the toner image to a second temperature, the second temperature being different from the first temperature, and so on.

22. The marking method of claim 20 further comprising selectively pre-heating only those parts of a media that correspond to the toner image by selectively heating one or more hotplates of the array of hotplates that correspond to the toner image.

23. The marking method of claim 20 further comprising adjusting an image quality of the image on the media by selectively heating only those portions of the media that corresponds to the image by selectively heating one or more hotplates of the array of hotplates that correspond to the image.

* * * * *